US011918040B1

(12) United States Patent
Snyder

(10) Patent No.: US 11,918,040 B1
(45) Date of Patent: Mar. 5, 2024

(54) STORAGE CASE AND METHODS THEREOF

(71) Applicant: Asher R Solutions Inc., Brooklyn, NY (US)

(72) Inventor: Asher Snyder, Brooklyn, NY (US)

(73) Assignee: ASHER R. SOLUTIONS, INC., Brooklyn, NY (US)

( * ) Notice: Subject to any disclaimer, the term of this patent is extended or adjusted under 35 U.S.C. 154(b) by 248 days.

(21) Appl. No.: 15/931,582

(22) Filed: May 13, 2020

Related U.S. Application Data

(60) Provisional application No. 62/847,244, filed on May 13, 2019.

(51) Int. Cl.

| | |
|---|---|
| ***A24F 15/00*** | (2020.01) |
| ***A24F 1/00*** | (2006.01) |
| ***A24F 15/02*** | (2006.01) |
| ***B65D 25/04*** | (2006.01) |
| ***B65D 43/16*** | (2006.01) |

(52) U.S. Cl.
CPC ..... *A24F 15/02* (2013.01); *A24F 1/00* (2013.01); *B65D 25/04* (2013.01); *B65D 43/16* (2013.01)

(58) Field of Classification Search
CPC .. A47F 1/00; A47F 23/04; A47F 15/01; A47F 15/18; A47F 15/12; B65D 25/04; B65D 43/16
USPC ..... 131/329; 206/236, 256, 242
See application file for complete search history.

(56) References Cited

U.S. PATENT DOCUMENTS

| | | | | |
|---|---|---|---|---|
| 7,717,259 | B2 * | 5/2010 | Hatton | A24F 15/18 206/236 |
| 8,584,842 | B2 * | 11/2013 | Fakhouri | A24F 9/04 206/236 |
| 2006/0243611 | A1 * | 11/2006 | Wu | B65D 85/1009 206/242 |

* cited by examiner

*Primary Examiner* — King M Chu
(74) *Attorney, Agent, or Firm* — Michael P. Kochka, Esq.

(57) ABSTRACT

A hand-held case is provided. In exemplary embodiments, the hand-held case comprises a central compartment defined by an outer wall, the central compartment sized to accept a smokable herb; a top lid comprising a cover for covering the central compartment, the top lid movable from a closed position to an open position; a bottom lid comprising a slidable cover for covering a bottom compartment; a tool compartment for storing a tool, the tool compartment disposed on a lateral side of the central compartment; and a pipe compartment for storing a pipe, the pipe compartment disposed on an opposite lateral side of the central compartment from the tool compartment.

15 Claims, 29 Drawing Sheets

STORAGE CASE AND METHODS THEREOF

CROSS-REFERENCE TO RELATED APPLICATIONS

The present application claims priority to U.S. Provisional Patent Application Ser. No. 62/847,244 entitled "STORAGE CASE AND METHODS THEREOF," filed May 13, 2019, the disclosure of which is incorporated herein by reference in its entirety as if fully set forth herein.

BACKGROUND

Embodiments of the present invention are generally related to a storage case and methods of utilizing the same. More specifically, embodiments of the present invention relate to an easily portable thin case that may comprise various compartments and storage areas for items such as a ground herb, a pipe, filter screens, a multi-tool, and/or the like.

Various smokable herbs such as ground cannabis, tobacco, or the like, may be stored in various cases and containers. One such case may be referred to as a dugout. A dugout may refer to a hand-held box typically made of wood with two compartments. One compartment holds a pipe and a second compartment holds a limited amount of ground cannabis. In use, a user would slide open the dugout, pull out the pipe and pack it by pressing it into the compartment containing smokable herbs such as ground cannabis, or the like. Dugouts are popular because of their portability, relative discreetness, and level of easiness to use. They are still relatively thick though and not as easily portable as other items commonly carried in a user's pocket, such as a mobile phone, a portable music player, or the like.

SUMMARY

Embodiments of the present disclosure generally relate to a storage case and methods of utilizing the same. In one embodiment, storage case my comprise a central compartment defined by an outer wall, the central compartment sized to accept a smokable herb; a top lid comprising a cover for covering the central compartment, the top lid movable from a closed position to an open position; a bottom lid comprising a slidable cover for covering a bottom compartment; a tool compartment for storing a tool, the tool compartment disposed on a lateral side of the central compartment; and a pipe compartment for storing a pipe, the pipe compartment disposed on an opposite lateral side of the central compartment from the tool compartment.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
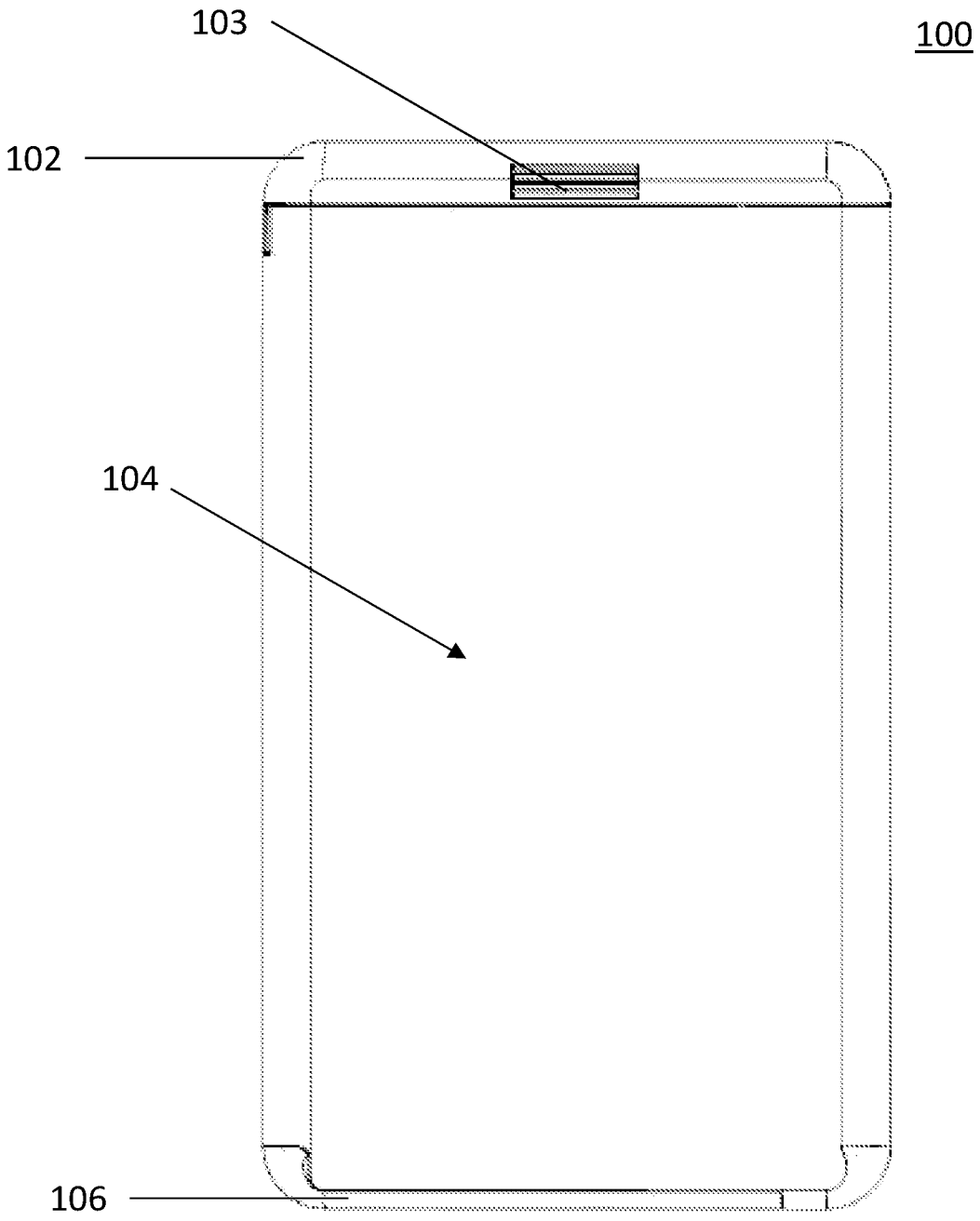
FIG. 1 depicts a front view of a case with a top lid in a closed position in accordance with embodiments of the present disclosure.
Figure 2:
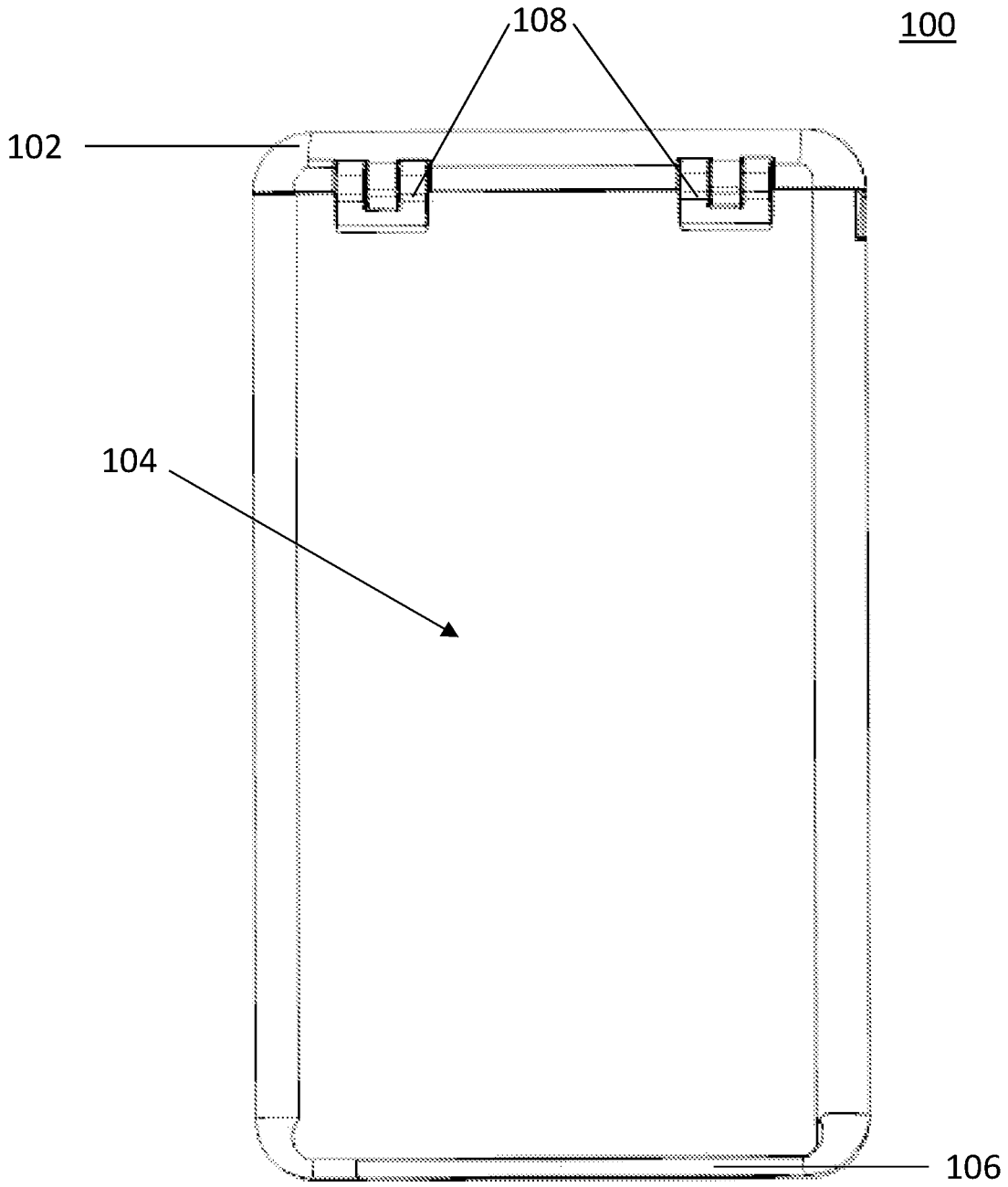
FIG. 2 depicts a back view of a case with a top lid in a closed position in accordance with embodiments of the present disclosure.
Figure 3:
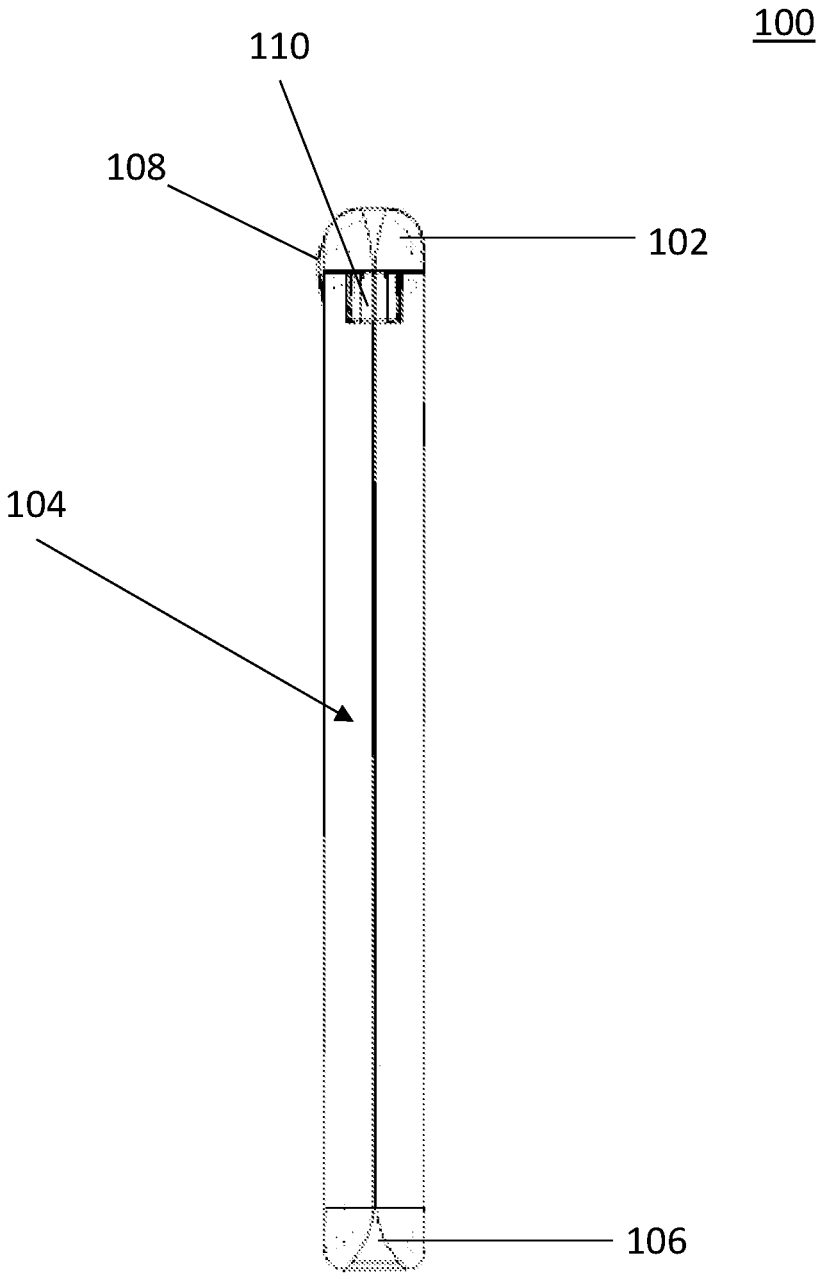
FIG. 3 depicts a left side view of a case with a top lid in a closed position in accordance with embodiments of the present disclosure.
Figure 4:
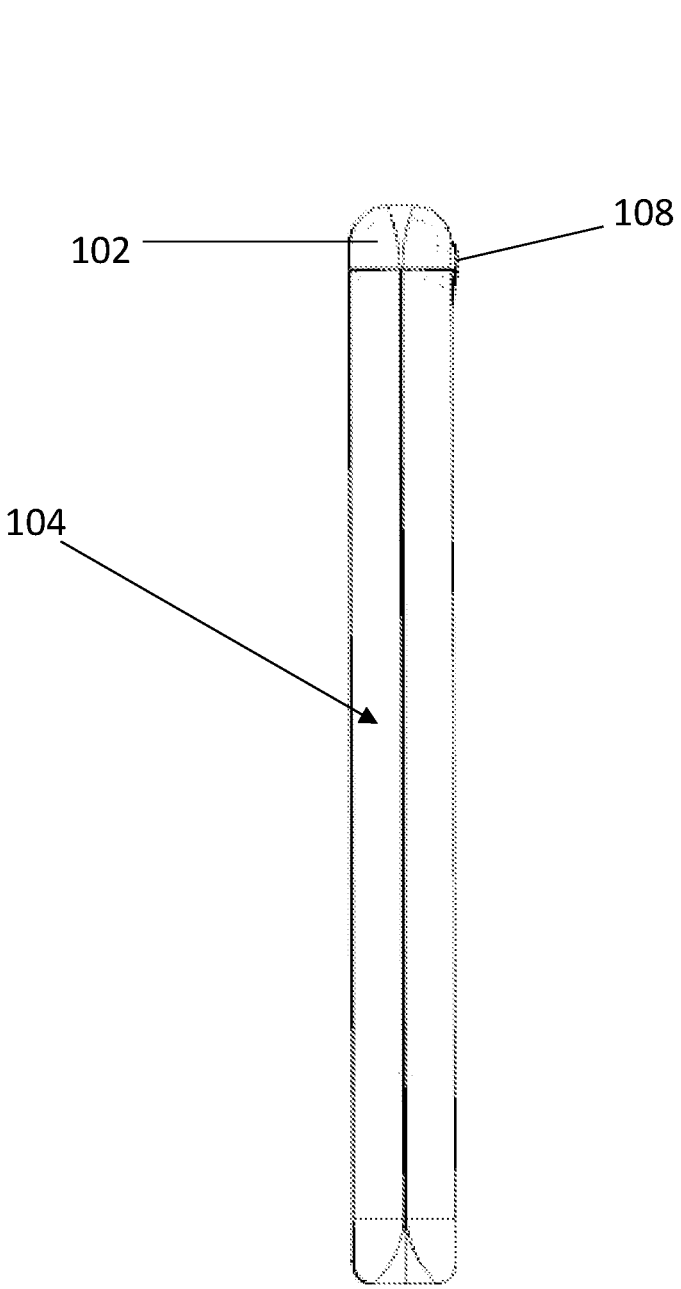
FIG. 4 depicts a right side view of a case with a top lid in a closed position in accordance with embodiments of the present disclosure.
Figure 5:
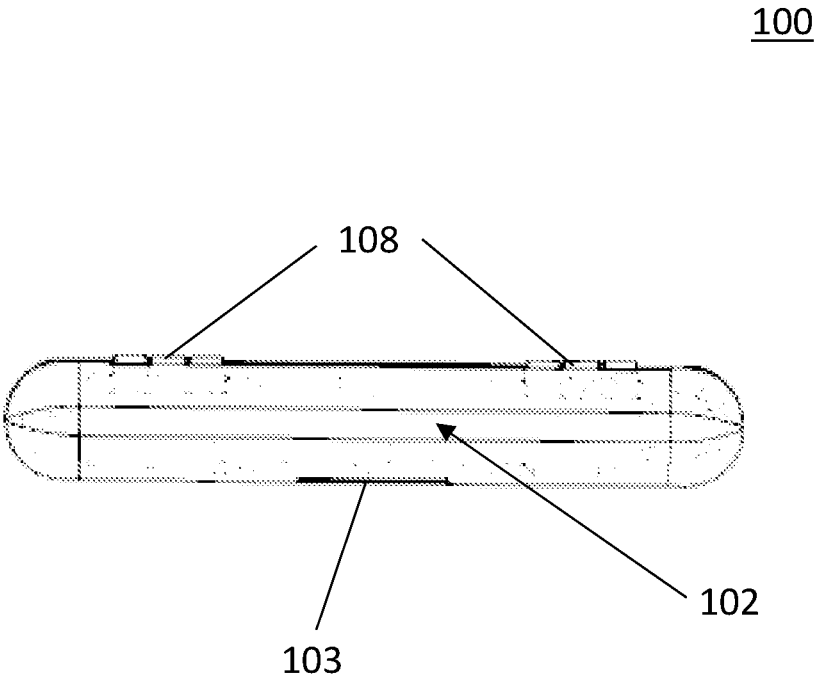
FIG. 5 depicts a top view of a case with a top lid in a closed position in accordance with embodiments of the present disclosure.
Figure 6:
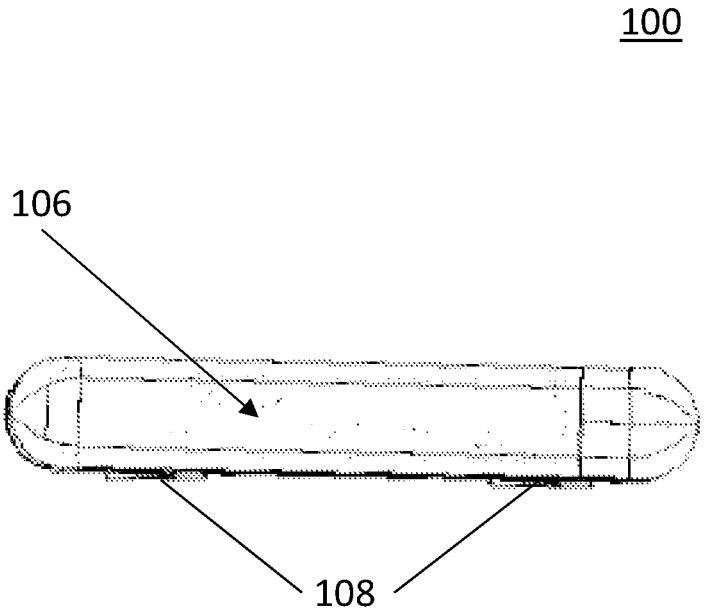
FIG. 6 depicts a bottom view of a case with a top lid in a closed position in accordance with embodiments of the present disclosure.
Figure 7:
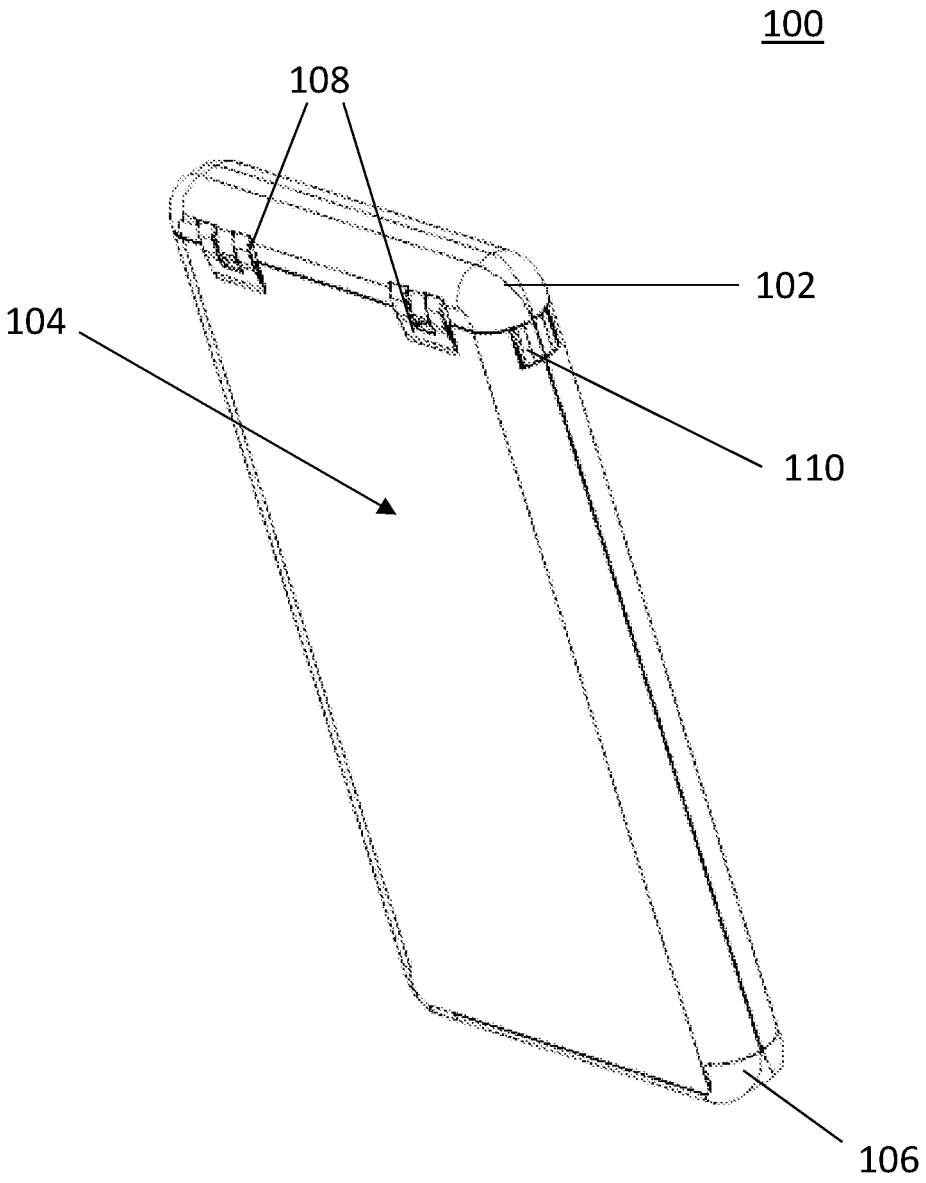
FIG. 7 depicts a back perspective view of a case with a top lid in a closed position in accordance with embodiments of the present disclosure.
Figure 8:
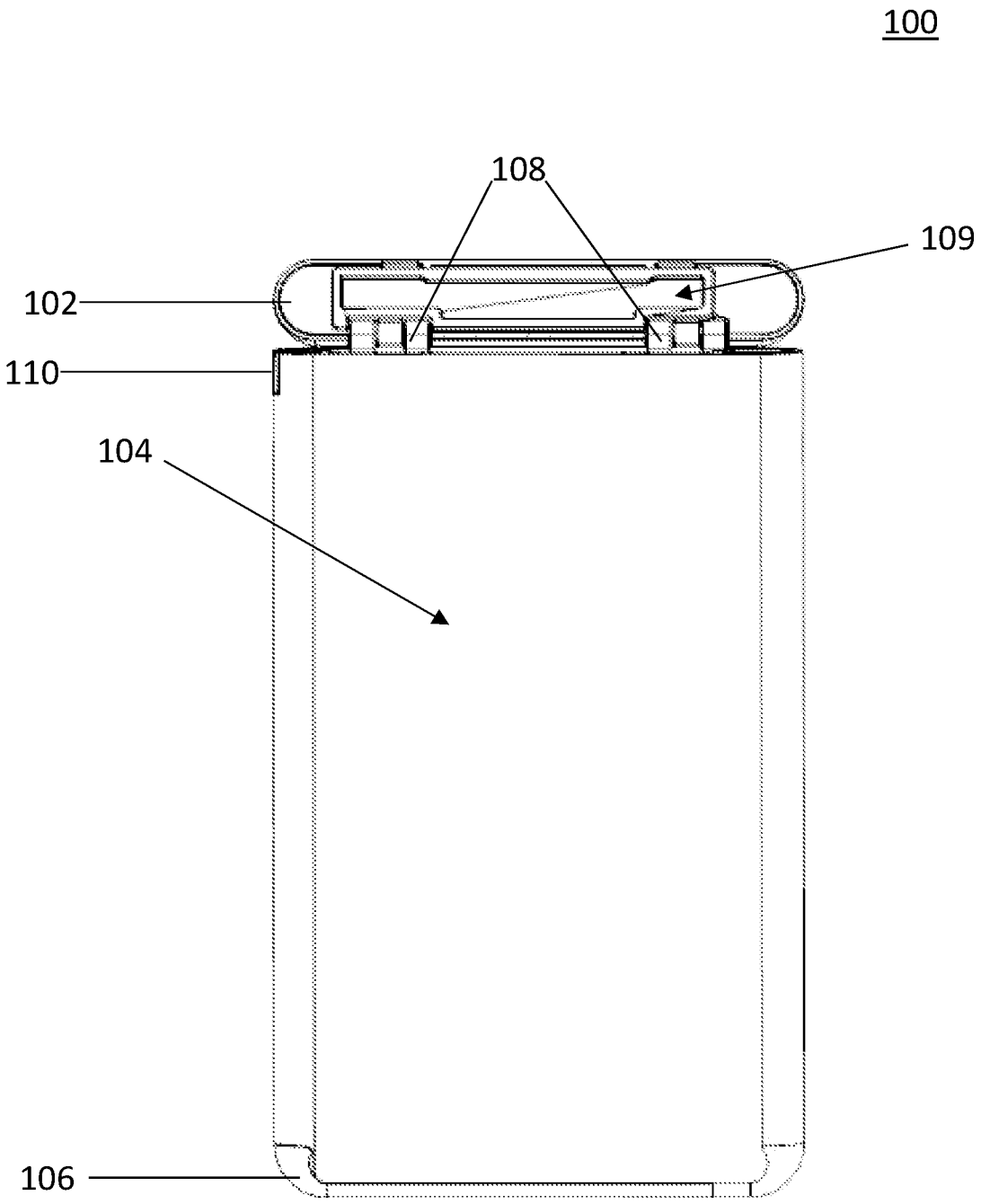
FIG. 8 depicts a front view of a case with a top lid in an open position in accordance with embodiments of the present disclosure.
Figure 9:
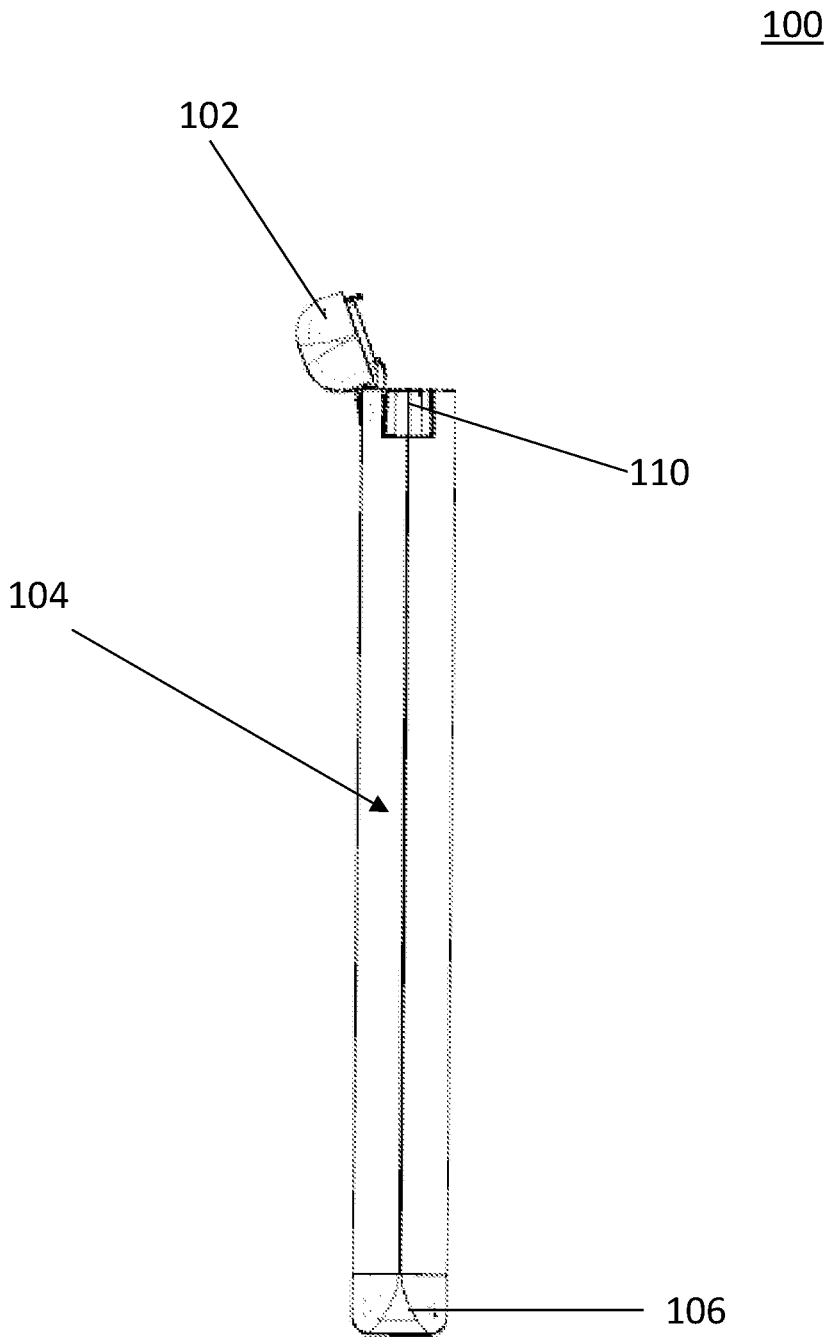
FIG. 9 depicts a left side view of a case with a top lid in an open position in accordance with embodiments of the present disclosure.
Figure 10:
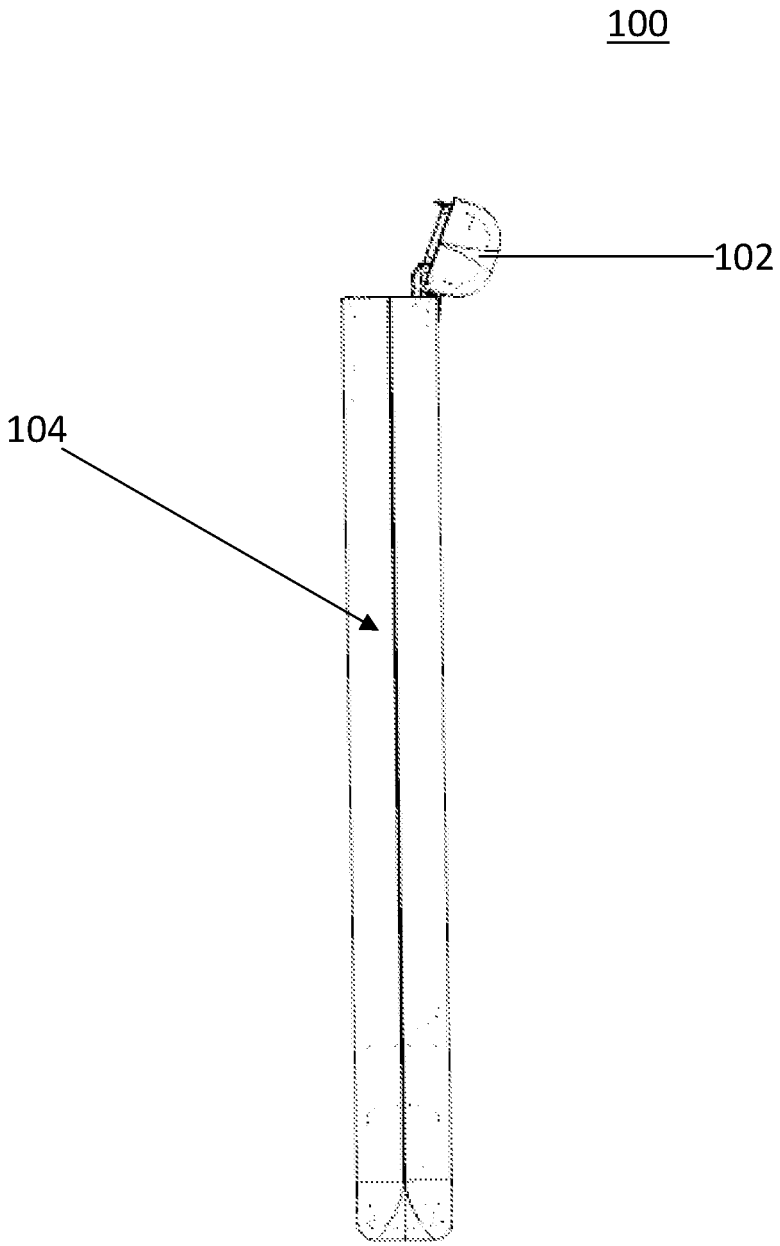
FIG. 10 depicts a right side view of a case with a top lid in an open position in accordance with embodiments of the present disclosure.
Figure 11:
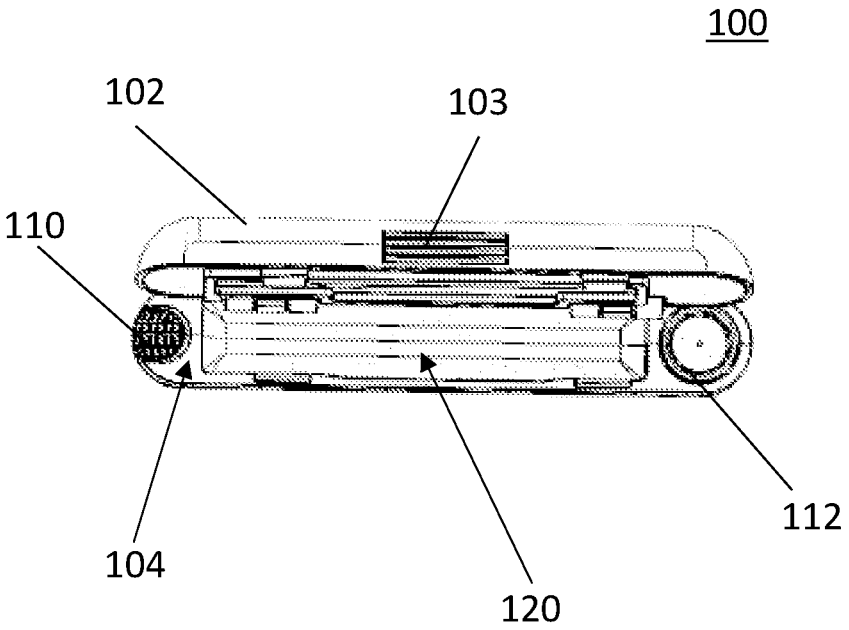
FIG. 11 depicts a top view of a case with a top lid in an open position holding a tool and a pipe in accordance with embodiments of the present disclosure.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention are generally related to a storage case and methods of utilizing the same. More specifically, embodiments of the present invention relate to an easily portable thin cannabis case that may comprise various compartment and storage areas for items such as a pipe, filter screens, a multi-tool, herb, and/or the like.

As used herein, the term "cannabis," "marijuana," or "herb" may refer to a product of a cannabis plant or hemp plant, a flowering plant including the species (or subspecies) *Cannabis sativa, Cannabis ruderalis*, and *Cannabis indica*, or the like. The term "bud" may refer to the flower of the mature marijuana plant, or the like. Buds may include portions of the plant that a user may dry, grind up, and/or smoke, or the like. While embodiments disclosed herein are discussed with respect to storage and use of cannabis, the storage of other smokable herbs, plants, or substances such as tobacco, or the like, is contemplated by and within the present disclosure.

Embodiments of the present disclosure depicted in the figures include a storage case that is thinner and more easily portable than a dugout or similar cases. Embodiments of the present disclosure may include a thin case that is designed and configured to store herb, pipe, filters, and a tool for packing and de-clumping smokable herb in a single portable unit.

Figure 12:
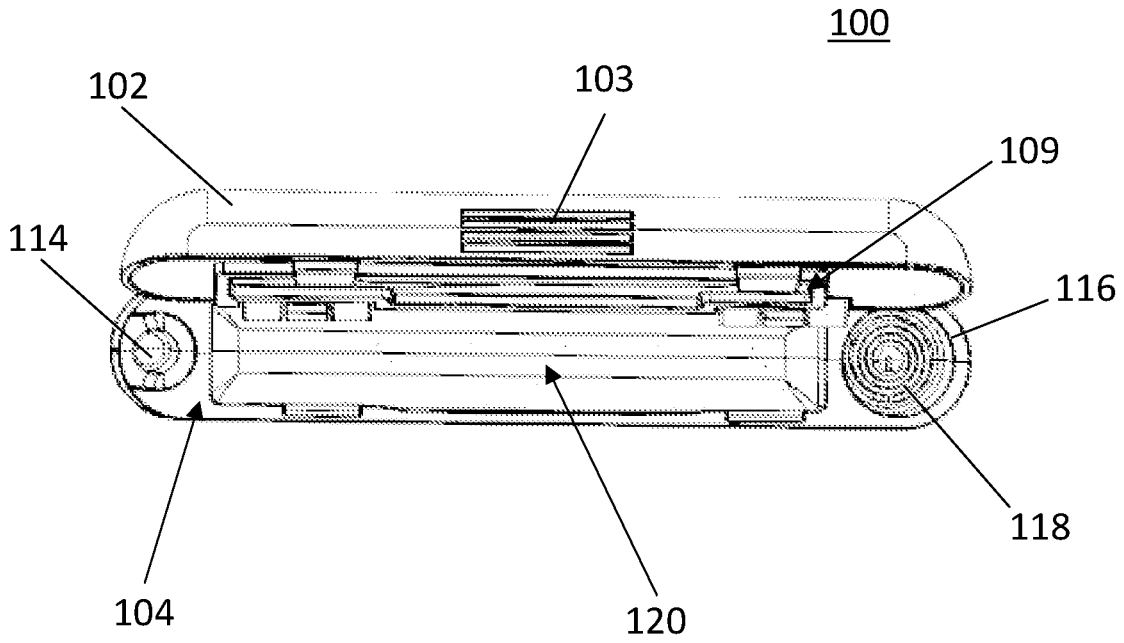
FIG. 12 depicts a top view of a case with a top lid in an open position without a tool and a pipe in accordance with embodiments of the present disclosure.
Figure 13:
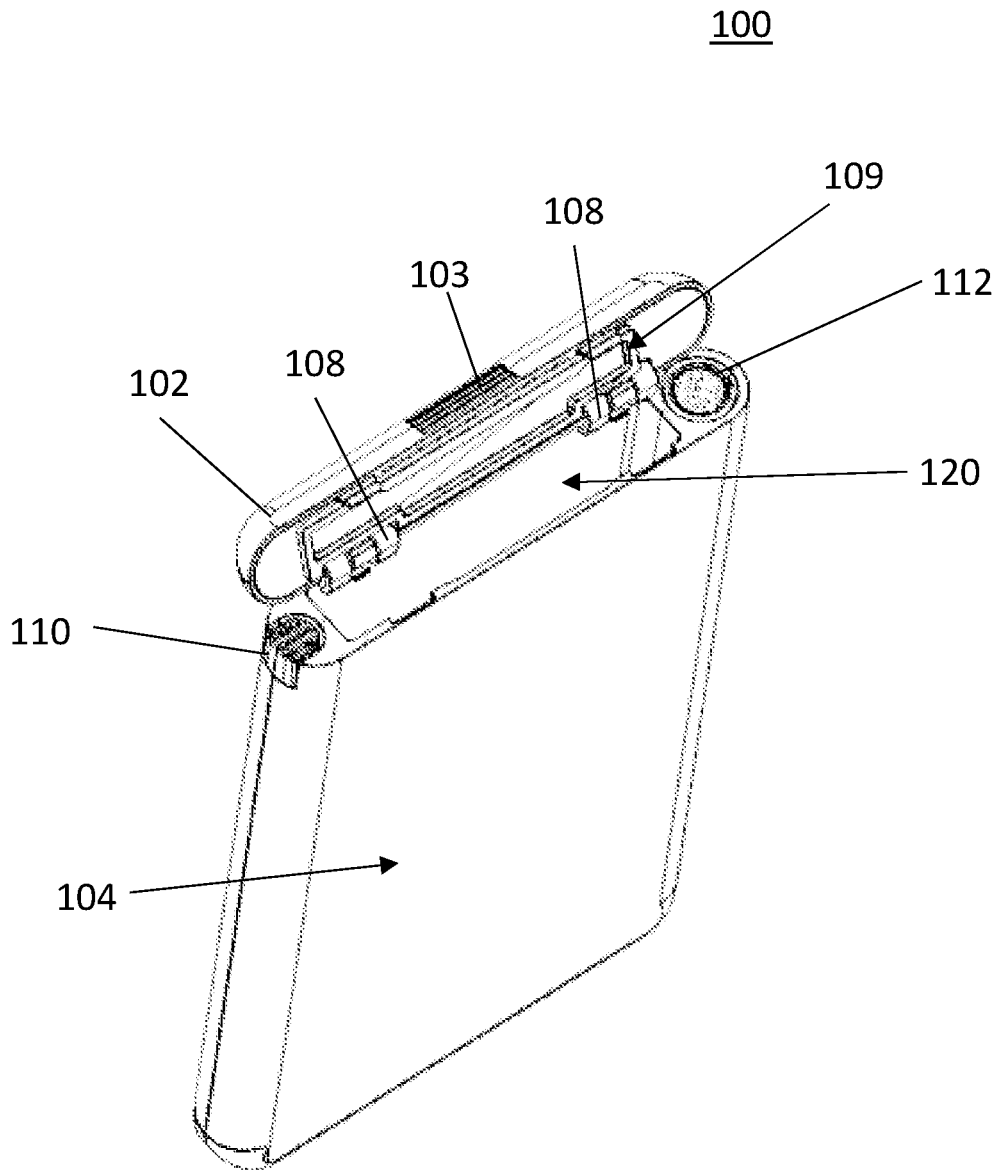
FIG. 13 depicts a front perspective view of a case with a top lid in an open position holding a tool and a pipe in accordance with embodiments of the present disclosure.
Figure 14:
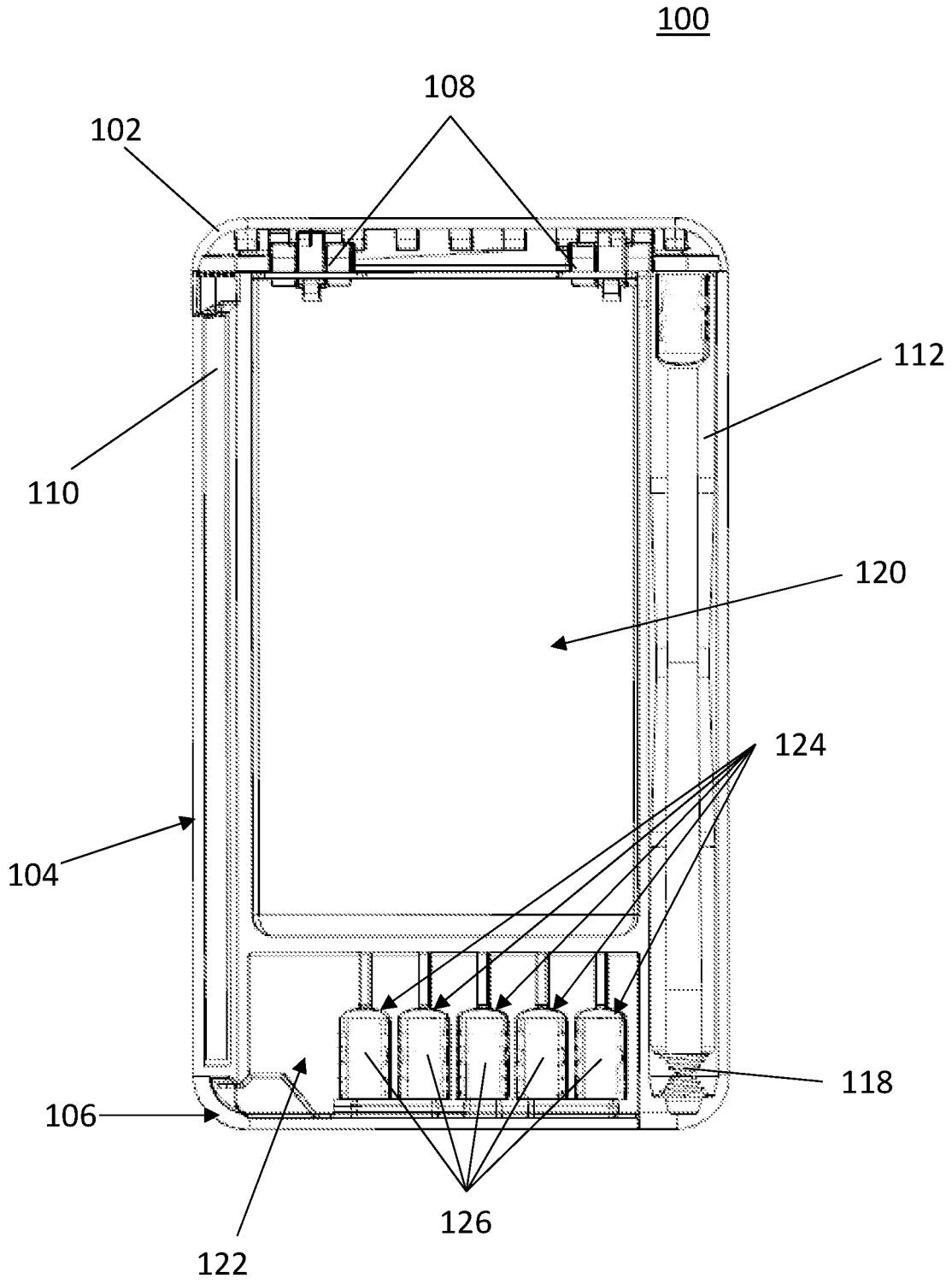
FIG. 14 depicts a front vertical cross-sectional view of a case with a top lid in a closed position in accordance with embodiments of the present disclosure.
Figure 15:
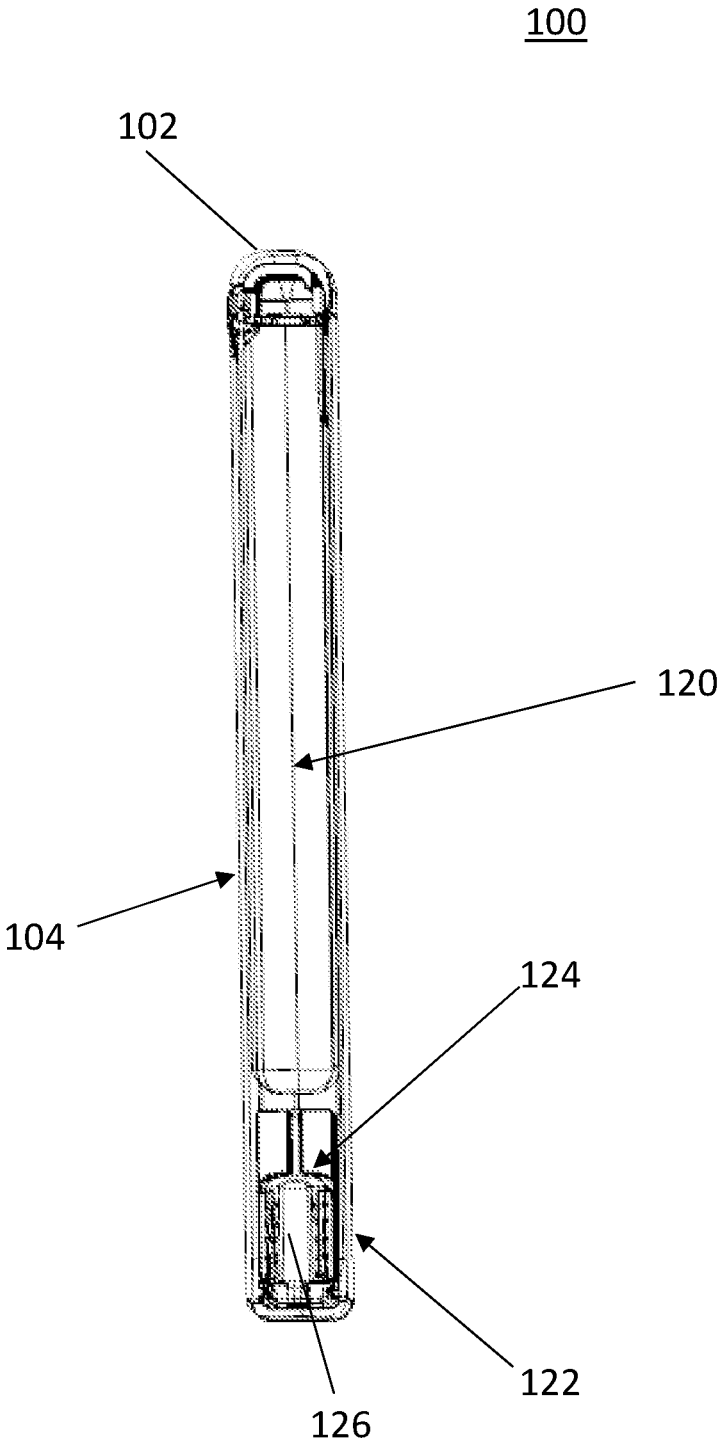
FIG. 15 depicts a side vertical cross-sectional view of a case with a top lid in a closed position in accordance with embodiments of the present disclosure.
Figure 16:
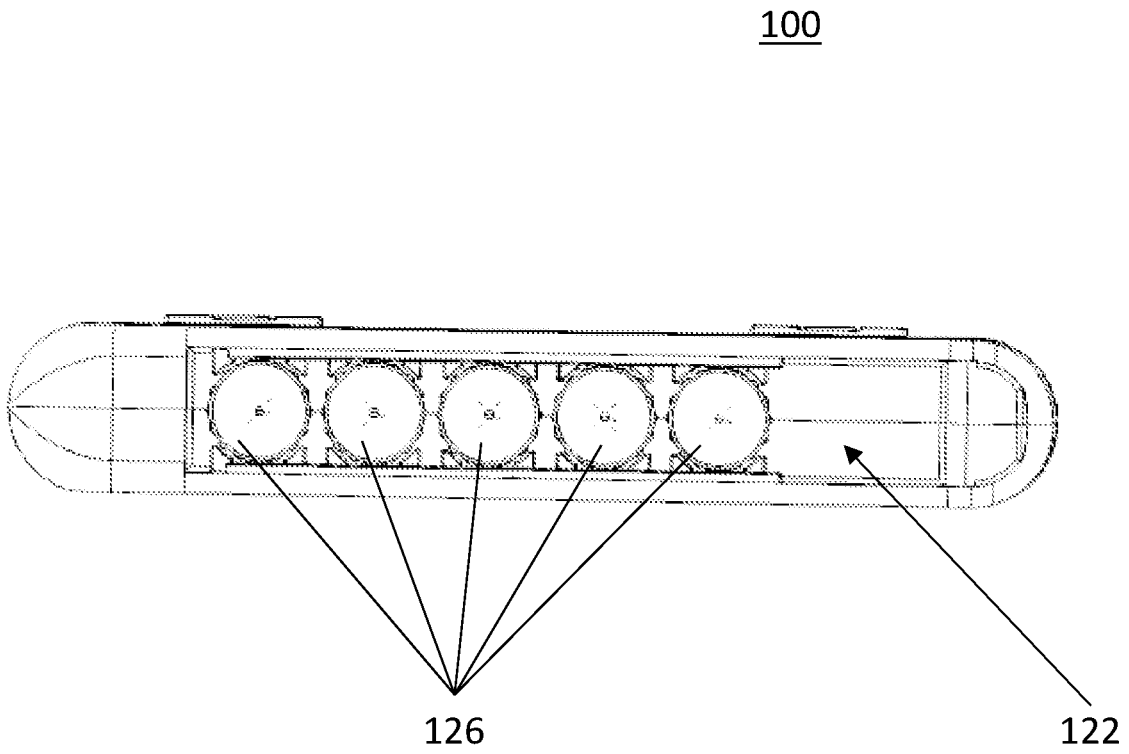
FIG. 16 depicts a bottom view of a case with a bottom lid removed in accordance with embodiments of the present disclosure.
Figure 17:
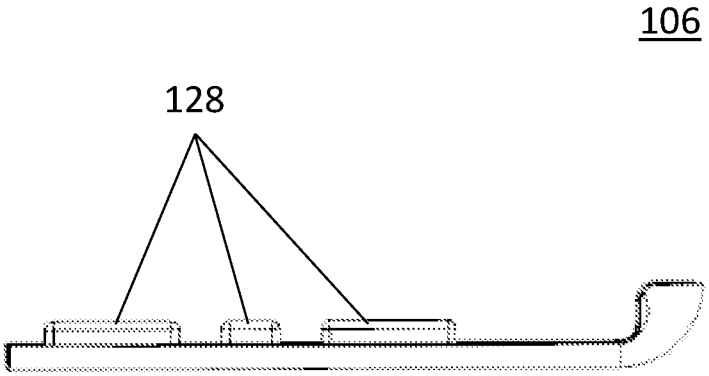
FIG. 17 depicts a side view of a bottom lid for a case in accordance with embodiments of the present disclosure.
Figure 18:
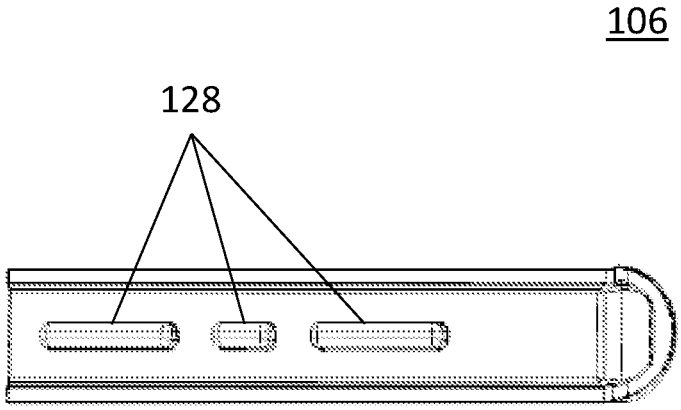
FIG. 18 depicts a top view of a bottom lid for a case in accordance with embodiments of the present disclosure.
Figure 19:
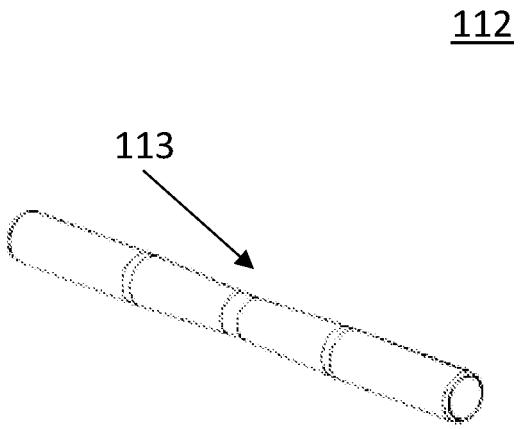
FIG. 19 depicts a perspective view of a pipe for a case in accordance with embodiments of the present disclosure.
Figure 20:
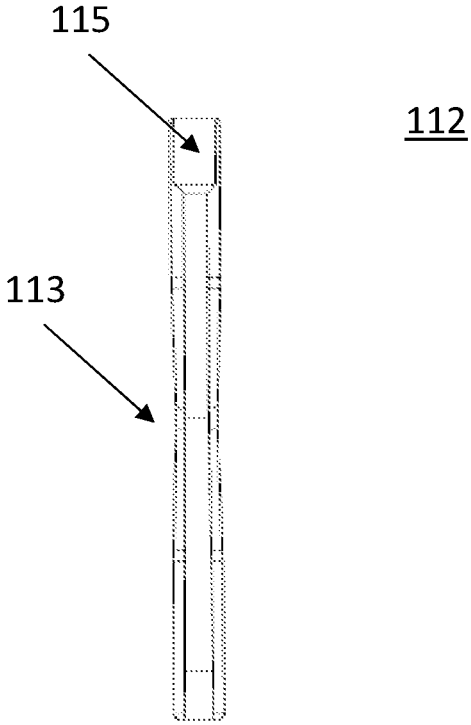
FIG. 20 depicts a cross-sectional vertical view of a pipe for a case in accordance with embodiments of the present disclosure.
Figure 21:
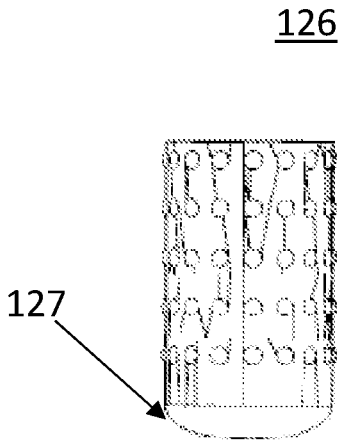
FIG. 21 depicts a side view of a filter for a case in accordance with embodiments of the present disclosure.
Figure 22:
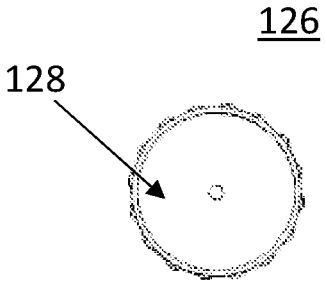
FIG. 22 depicts a side view of a filter for a case in accordance with embodiments of the present disclosure.
Figure 23:
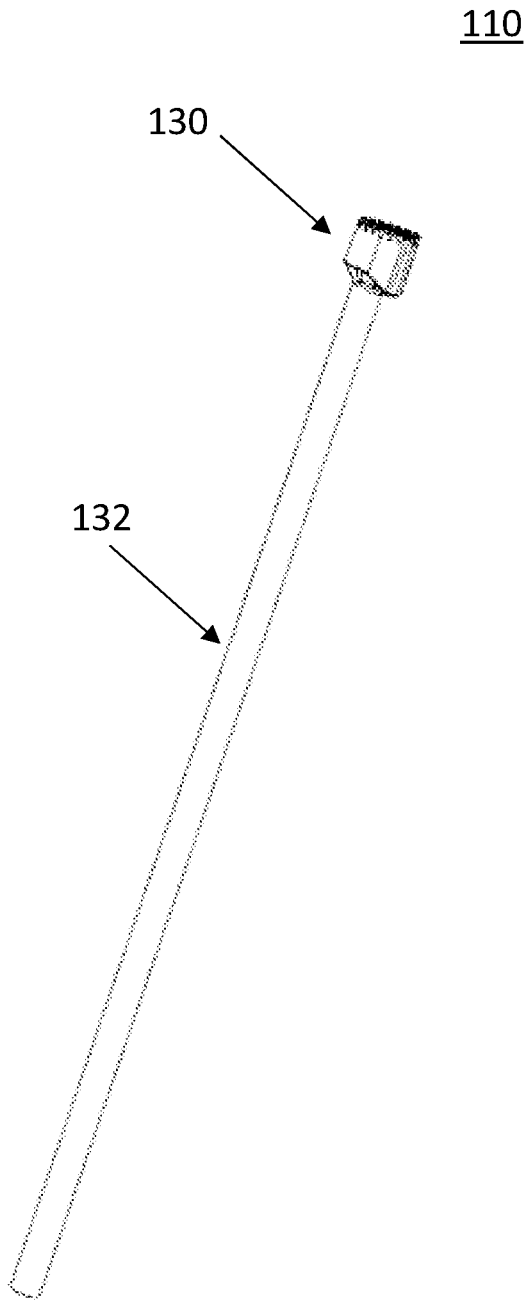
FIG. 23 depicts a perspective view of a tool for a case in accordance with embodiments of the present disclosure.
Figure 24:
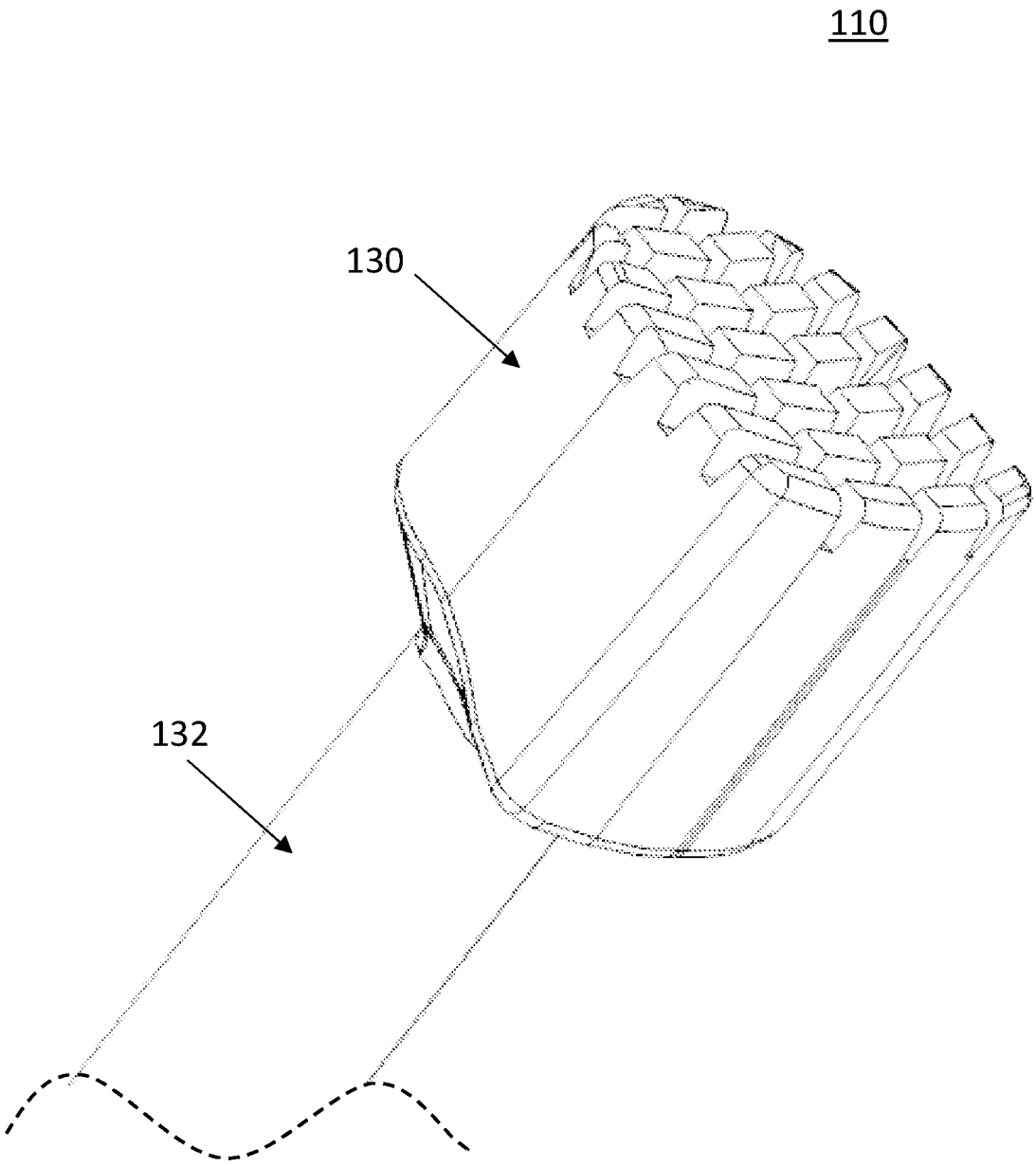
FIG. 24 depicts a perspective view of a tool for a case in accordance with embodiments of the present disclosure.
Figure 25A:
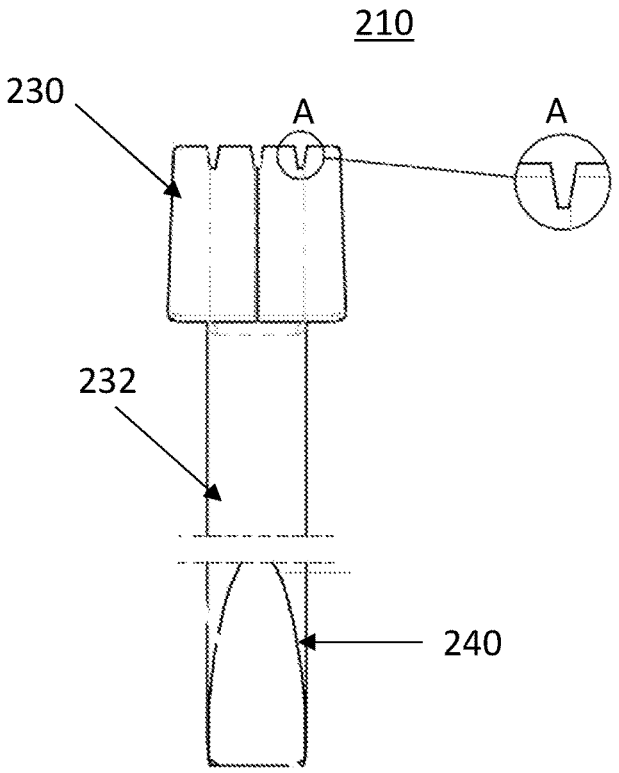
FIG. 25A depicts a front view of a tool for a case in accordance with embodiments of the present disclosure.
Figure 25B:
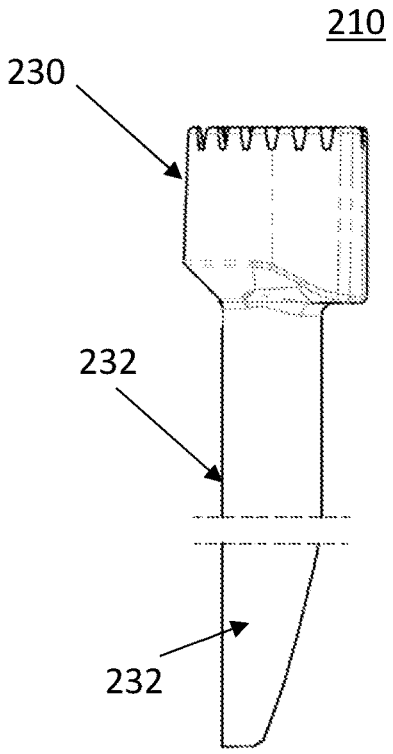
FIG. 25B depicts a side view of a tool for a case in accordance with embodiments of the present disclosure.
Figure 26:
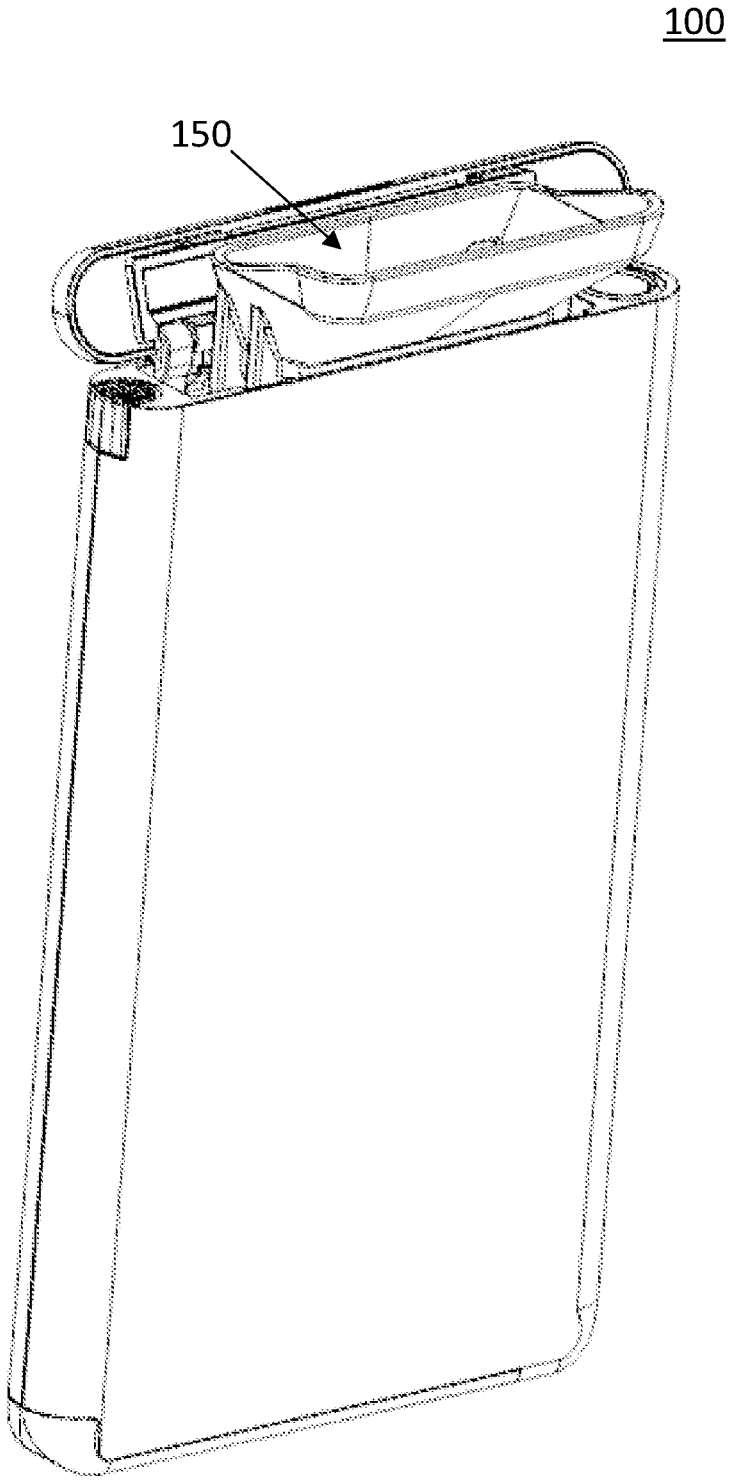
FIG. 26 depicts a perspective view of a funnel and a case in accordance with embodiments of the present disclosure.
Figure 27:
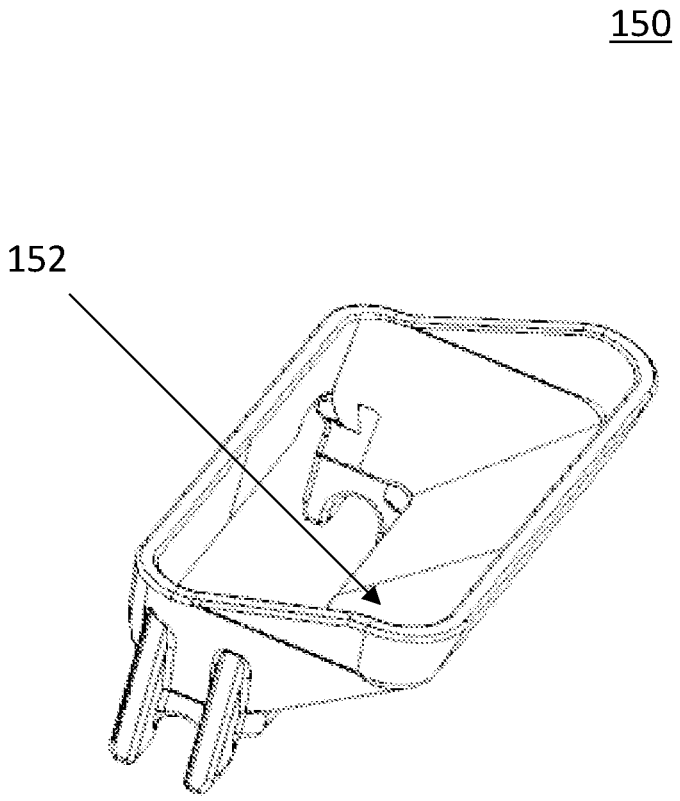
FIG. 27 depicts a perspective view of a funnel for a case in accordance with embodiments of the present disclosure.
Figure 28A:
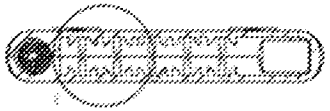
FIG. 28A-N depict views of a case in accordance with embodiments of the present disclosure.
Figure 28B:
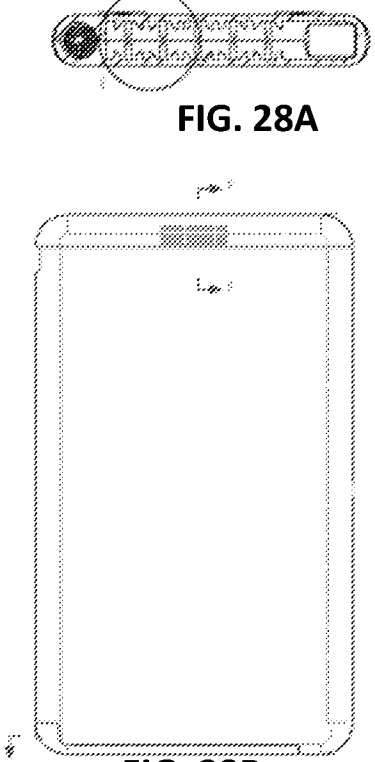
Figure 28C:
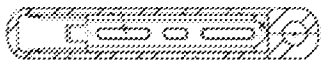
Figure 28D:
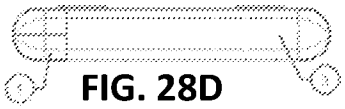
Figure 28E:
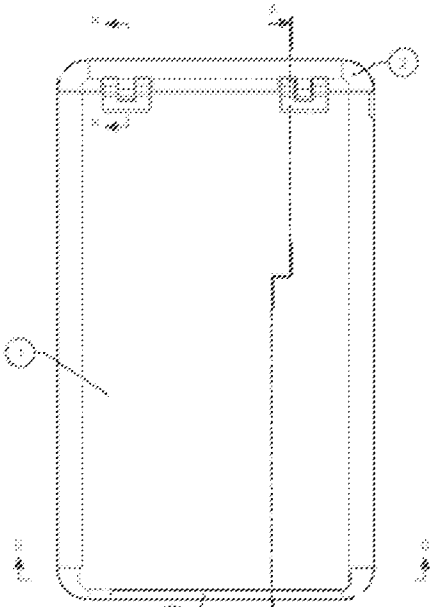
Figure 28F:
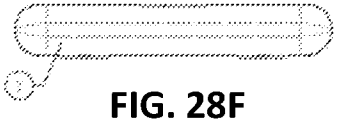
Figure 28M:
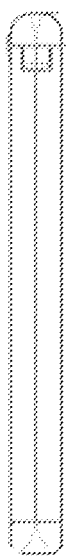
Figure 28G:
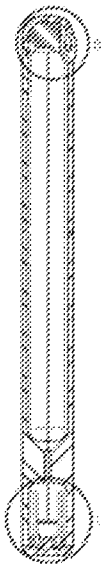
Figure 28I:
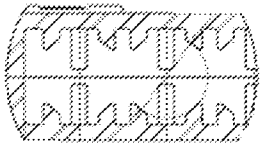
Figure 28H:
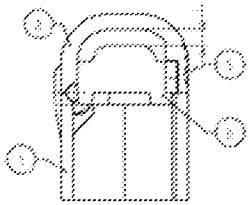
Figure 28N:
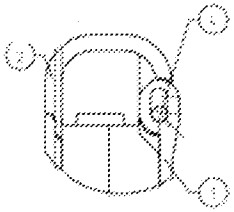
Figure 28L:
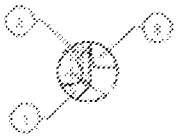
Figure 28K:
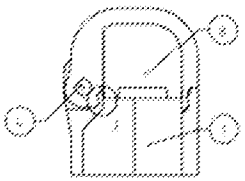
Figure 28J:
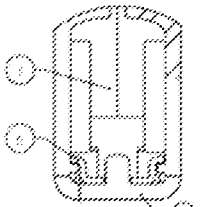

Referring now to FIGS. 1-16, a storage case 100 in accordance with embodiments of the present disclosure is depicted. The storage case 100 may comprise an herb or central compartment 120, a bottom compartment 122, a top lid 102, a grip 103, an outer wall 104, hinges 108, a seal 109, a filer compartment 124, a bottom lid 106, a smoking device or pipe 112, and a tool or multi-tool 110. Each of these elements will be described in greater detail with respect to the additional figures. Referring to FIG. 12, a case 100 is depicted with the pipe 112 and multi-tool 110 removed. The case 100 may comprise a tool compartment 114 for housing the multi-tool 110 and a pipe compartment 116. Inside the pipe compartment 116 may be a spring 118 for biasing the pipe 112 in an upward direction out of the case 100, so that when the top lid 102 is opened, the pipe may raise out of the pipe compartment 116. Referring to 14, a front vertical cross-sectional view of a case 100 with a top lid 112 in a closed position in accordance with embodiments of the present disclosure. The case 100 may comprise a bottom compartment 122 and one or more pipe filter compartments 124 for housing pipe filters 126, or the like. The case 100 may be adapted to store and carry an amount of cannabis, which may be ground, or the like. FIGS. 17 and 18 depict a bottom lid 106 with a filter opening 128 in accordance with embodiments of the present disclosure. FIGS. 19 and 20 depict an exemplary pipe 112 comprising a tapered portion 113 and a pipe filter slot 115. FIGS. 21 and 22 depict a pipe filter 126 comprising a rounded bottom 127. FIGS. 23-24 depict a multi-tool 110 comprising a tool head 130 and a tool plunger 132. FIGS. 25A and 25B depict a multi-tool 210 comprising a tool head 230, a tool plunger 232, and a tool shovel 240. FIGS. 26 and 27 may depict a case 100 with a funnel 150 having a funnel opening 152 for funneling, herbs into the container 100, or the like. A case in accordance with embodiments of the present disclosure may comprise a slim and sleek design. The case may be made of stainless steel, although any suitable combination of rigid or semi-rigid material such as metals, polymers, ceramics, or composites is contemplated by and within embodiments of the present disclosure. The case may comprise a metal with a shiny appearance on the exterior of the case. The case may be made of quality sturdy components that are designed to resist breaking or damage with normal use. For example, the case may comprise a lid with a hinge comprising a thickness to resist breaking when the case is opened and closed, or the like.

In exemplary embodiments, the case may comprise the following benefits: solid stainless steel piece, Ultra slim, Unique filter screens, Unique flip top with hinge and rear hinge snap, Lots of storage room, Storage for filter screens on unique slide bottom with additional piece, Unique custom fit elastomer on top to create airtight and waterproof seal, Custom hourglass pipe spring, 3 in 1 multi-tool to pack, declump, and clean pipe (fits perfectly to complete case, Pipe design, Perfect hand feel, One handed use, Unique funnel.

A hand-held case comprising: a central compartment defined by an outer wall, the central compartment sized to accept a smokable herb; a top lid comprising a cover for covering the central compartment, the top lid movable from a closed position to an open position; a bottom lid comprising a slidable cover for covering a bottom compartment; a tool compartment for storing a tool, the tool compartment disposed on a lateral side of the central compartment; and a pipe compartment for storing a pipe, the pipe compartment disposed on an opposite lateral side of the central compartment from the tool compartment. A hand-held case may comprise a top lid attached to the wall with a hinge. The hand-held case may comprise a top lid in a closed position, wherein the hinge sits flush against the outer wall. A hand-held case may comprise a top lid further comprising a magnet for securing the lid to the outer wall when the top lid is in the closed position, wherein the magnet is disposed on the cover in a position adjacent to the side wall when the top lid is in the closed position.

A hand-held case is disclosed wherein the top lid further comprises a seal on an interior surface of the lid adjacent the central compartment when the top lid is in the closed position, the seal making the inside of the central compartment substantially airtight when the top lid is in a closed position.

A hand-held case further comprises a grip comprising grooves for allowing a user to move the top lid between the open closed position and the open position.

A hand-held case, wherein the outer wall comprises steel.

A hand-held case of claim 1, further comprising a tool, the tool adapted to scoop out the smokable herb from the central compartment, compact the smokable herb, and clean the central compartment.

A hand-held case, further comprising a pipe with a tapered center for allowing a user to more easily grip the pipe, the pipe for smoking a smokable herb.

A hand-held case, wherein the pipe comprises a pipe filter slot for storing a p filter, the filter adapted to filter the smokable herb.

A hand-held case, wherein the pipe is spring loaded with a spring at the bottom of the pipe compartment, wherein the pipe partially exits the pipe compartment when the top lid is moved from the closed position to the open position, and the top lid compresses the pipe against the spring when the top lid is the closed position.

A hand-held case, wherein the bottom compartment comprises at least one filter compartment for storing one or more filters for use with a pipe.

A hand-held-case, further comprising one or more filters for use with a pipe, the one or more filters stored within the at least one filter compartment.

A hand-held case may comprise one or more filters comprising an opening for accepting the smokable herb and a rounded bottom portion for seating within the pipe.

A hand-held case, may further comprise a funnel for seating within an opening at the top of the central compartment and allowing smokable herb to be transferred into the central compartment.

A hand-held case may comprise a central compartment defined by an outer wall, the central compartment sized to accept a smokable herb; a top lid comprising a cover for covering the central compartment, the top lid movable from a closed position to an open position, the top lid attached to the wall with a hinge, the top lid further comprising a magnet for securing the lid to the outer wall when the top lid is in the closed position; a bottom lid comprising a slidable cover for covering a bottom compartment; a tool compartment for storing a tool, the tool compartment disposed on a lateral side of the central compartment; a pipe compartment for storing a pipe, the pipe compartment disposed on an opposite lateral side of the central compartment from the tool compartment; a tool, the tool adapted to scoop out the smokable herb from the central compartment, compact the smokable herb, and clean the central compartment; a pipe with a tapered center for allowing a user to more easily grip the pipe, the pipe for smoking a smokable herb, the pipe comprising filter slot for storing a pipe filter, the filter adapted to filter the smokable herb.

A method for using a hand-held case may comprise providing a hand-held case comprising: a central compartment defined by an outer wall, the central compartment sized to accept a smokable herb; a top lid comprising a cover for covering the central compartment, the top lid movable from a closed position to an open position, the top lid attached to the wall with a hinge, the top lid further comprising a magnet for securing the lid to the outer wall when the top lid is in the closed position; a bottom lid comprising a slidable cover for covering a bottom compartment; a tool compartment for storing a tool, the tool compartment disposed on a lateral side of the central compartment; a pipe compartment for storing a pipe, the pipe compartment disposed on an opposite lateral side of the central compartment from the tool compartment; a tool, the tool adapted to scoop out the smokable herb from the central compartment, compact the smokable herb, and clean the central compartment; a pipe with a tapered center for allowing a user to more easily grip the pipe, the pipe for smoking a smokable herb, the pipe comprising filter slot for storing a pipe filter, the filter adapted to filter the smokable herb; and removing the pipe from the hand-held case; placing a filter in the pipe; and removing the smokable herb and placing it in the filter.

Figures 29A, 29B, 29C, 29D, 29E, 29F, 29G, 29H, 29I, 29J, 29K, 29L, 29M:
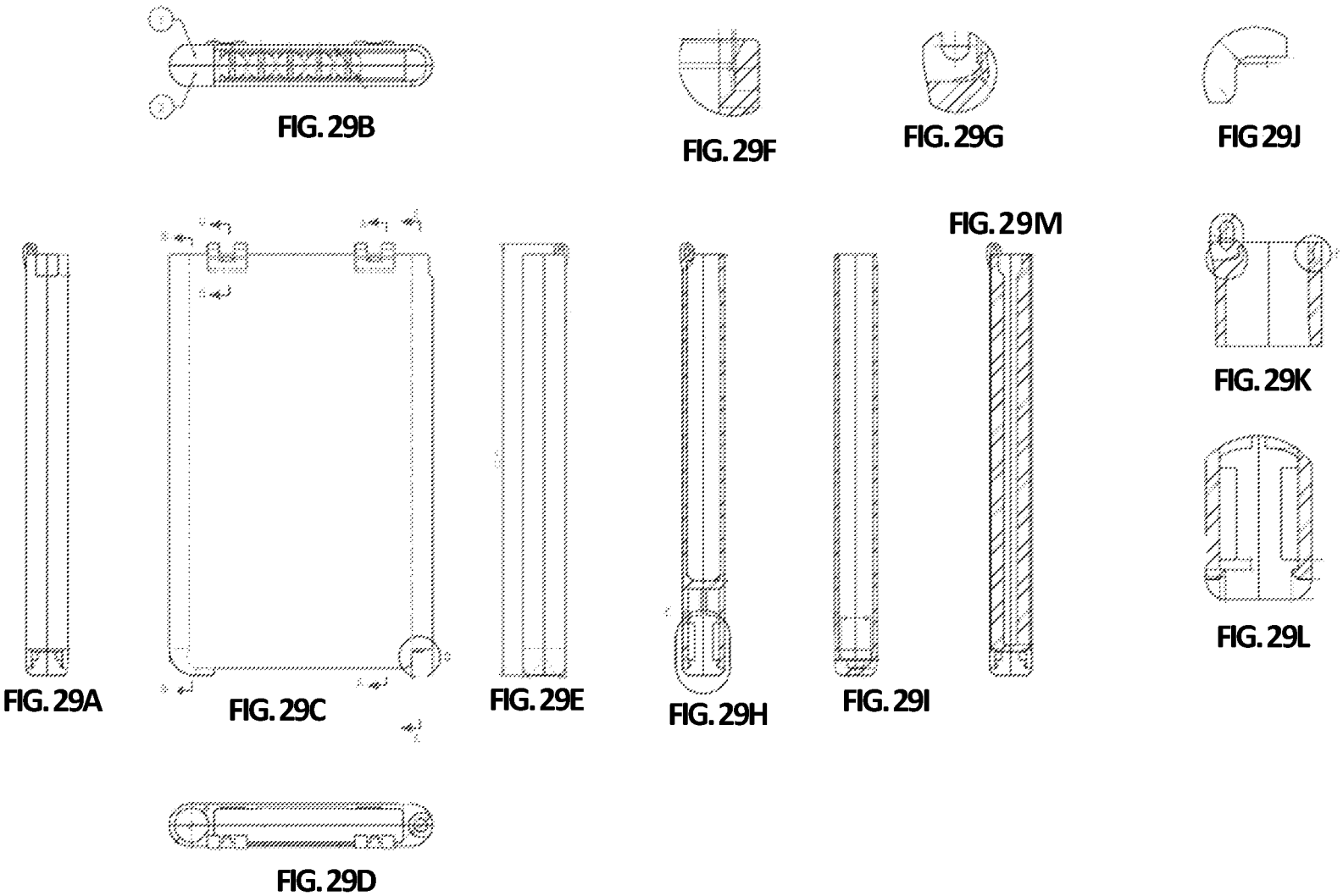
FIG. 29A-M depict views of a case in accordance with embodiments of the present disclosure.

FIG. 29L depict a views of a case in accordance with embodiments of the present disclosure.

The case may comprise a top portion and a bottom portion. The top portion may comprise a hinged lid covering openings to several interior storage areas within the case. The storage areas may comprise a pipe storage area, a cannabis storage area, and a tool storage area, or the like. The pipe storage and tool storage areas or compartments may comprise cylindrical openings in a top portion of the case near the edges disposed on opposing lateral sides of the case, or the like. The cannabis storage area or compartment may comprise a generally oval shaped aperture in the center of the top of the case entering into a cavity extending down into the case. The cannabis storage area may extend down more than 50% of the length of the case, or the like. The cannabis storage area may be disposed between the pipe storage area and the tool storage area.

In some embodiments, the width of the case may be between 6-9 mm. In some embodiments, the width of the case may be approximately or exactly 8 mm. For example, the width of the case may be 7.99 mm, 8.01 mm, or the like. This slim design allows the case to be easily handled in the user's hand and portable in the user's pocket, similar to the way a mobile telephone would be portable. A case in accordance with embodiments of the present disclosure may be designed and sized to fit comfortably within the palm of a user's hand. The case may include a front and a back side that may be suitable for license engraving, or the like.

In some embodiments, the case may comprise a filter screen compartment, or the like, on the bottom of the case. The compartment may be sized to fit one or more filter screens for use with a pipe or similar smoking device. In some embodiments, the filter screen compartment may be designed and sized to fit 2-8 filter screens. For example, the filter screen compartment may be designed and sized to fit and store 5 filter screens, or the like. In some embodiments, the bottom panel may have a slidable cover, wherein the cover may be removed by sliding it laterally off the bottom of the case. Other types of covers are contemplated by and within embodiments of the present disclosure.

A filter screen compartment may store a number of filter screens adjacent to each other at the base of the case below a cannabis storage compartment, or the like. In some embodiments, the cover of the filter screen compartment may be spring loaded. A filter screen may last approximately 1-2 weeks depending on use. In some embodiments, the filter screen may comprise a "cap" or "thimble-like" shape and be adapted to couple with or attach to a pipe or smoking device to filter out unwanted elements while smoking the pipe or smoking device. The filter screens may keep the cannabis herb, and the associated scents, or the like, contained. The filter screens may allow the user to get more pulls and prevents the dispersion of ash, embers, lost herb, and/or the like. The filter screens generally make for a much smoother smoking experience for the user.

In some embodiments, a cylindrical insert pipe filter may be included that fits snugly in front of any pipe. Other larger pipes/bongs, etc. use a flat sheet screen, or a large solid metal cylinder with top hat rim. In exemplary embodiments, a rimless cylindrical mesh screen may be provided. In some embodiments, the mesh screen or "filter" screen may comprise approximately a 5 mm diameter×8 mm. In some embodiments, a filter screen may be adapted to fit pipes of various sizes. A filter screen may be sized and designed to fit within an end or opening of a pipe in accordance with exemplary embodiments. The filter screen may be made of a metallic material or any suitable material to resist breaking or damage. In some embodiments, the filter screen may be inserted and/or removed by hand. In some embodiments, the filter screen may be removed with a tool adapted to fit in the opposite end of the pipe from the filter screen and push the filter screen out of the pipe. The tool may be cylindrical in shape or comprise any shape suitable for fitting within the inside of the pipe to push out the filter screen on an opposite end.

In some embodiments, the top of the case may comprise a lid. The lid may be attached via a hinge, which may be spring-loaded. In exemplary embodiments, the lid, or the like, may be attached via a flat or substantially flat hinge that is positioned adjacent to and/or flush with a rear wall of the case. Any protrusion of the lid from the case is minimized and the appearance of the hinge is that is completely flat and flush with a rear wall of the case. This contrasts with other hinges that may be positioned behind the wall and protrude more. The lid may be adapted to cover both a cannabis storage compartment, a tool storage compartment, and/or a pipe storage compartment.

In exemplary embodiments, a case may comprise a seal with magnets and thin clamps. The case may be designed with a precision seal with clamps and magnet, so the case is securely sealed but able to be opened by hand with a predetermined amount of pressure. In exemplary embodiments, the case may include a hook, such as a a rear hook to catch a rear hinge and keep it locked down such that it's a tight seal without minimal or no gaps. The lid may have an interior portion that may comprise a sealing material, such as silicone, or the like. In some embodiments, the lid may comprise one or more magnets adapted to magnetically couple with a base portion of the case, such that the lid is biased closed by the magnetic coupling until the user places enough pressure on the lid to separate the magnet in the lid from the base portion of the case. Other suitable mechanisms for keeping the lid closed, such as clips, or the like, are contemplated by and within the present disclosure.

In exemplary embodiments, the lid may comprise a food-safe seal. The seal may be disposed and coupled with an interior side of the lid. The seal may comprise a silicone or rubber seal that creates a seal between the lid and the various compartments in the top portion of the container, wherein freshness and odor prevention. The seal may substantially minimize odors escaping from the interior of the case and the cannabis compartment, or the like.

In some embodiments of the present disclosure, a case may comprise a removable pipe, smoking device, or the like. A pipe may comprise an ergonomic design for ease of handling by a user. A pipe included may comprise wider ends that taper to a narrower center portion of the pipe. The outer surface of the pipe may have a generally concave curvature. The narrow portion may enable the pipe to be grasped between a user's fingers and prevent the pipe from sliding out of the user's fingers when grasped. The pipe may be stored in a pipe storage compartment within a case in accordance with the exemplary embodiments.

The pipe may be spring loaded such that when a user opens the lid of the case, the pipe will raise out of the case so that it may be grabbed by the user's fingers relatively easily. The pipe may be adapted to fit within a cannabis storage compartment of the case, such that the exterior of the pipe fits snugly against the interior walls of the cannabis storage compartment. This snug fit will enable the user to collect the cannabis, or the like, with the pipe so that minimal, if any, cannabis remains on the interior walls after the pipe is inserted.

In some embodiments of the present disclosure, the case may comprise a tool storage compartment sized to store a tool. The tool may comprise a thicker tip end with protruding bumps on the distal tip for de-clumping. At times, cannabis or other smokable material may become clumped within the cannabis compartment. A tool may have at least one wider end for inserting into the compartment to de-clump the cannabis, or the like. The tool may be stored within a cylindrical compartment on an opposite side the pipe is stored. The cannabis compartment may be disposed between the pipe storage compartment and the tool storage compartment, or the like.

In some embodiments, the wider end of the tool may be inserted into an interior portion of the pipe to pack cannabis, or the like, into the pipe or a smoking device. The wider end may be circular in shape such that it fits snugly within the interior circumference of the pipe to enable packing. The tool may comprise a narrower end opposite the wider end that may be used to clean the interior of the pipe and/or pop out or remove a filter attached to the pipe, or the like. The tool storage compartment may be sized to store and accept the narrower end of the tool, such that when the narrower end of the tool is inserted into the tool storage compartment, the wider end of the tool acts as a stop to prevent the entire tool from entering the tool storage compartment. The wider end of the tool may comprise a lip that overhangs an opening into the tool storage compartment, or the like, when the tool is inserted fully into the tool storage compartment. When fully inserted into the tool storage compartment, the tool may fit underneath a portion of the lid of the case, or the like.

A case may not have a springed lid, and may include larger inset magnets, clips, a smaller inset hinge area, better rear hinge clasp.

An extended track for bottom panel, prevents sliding off.

A variation of a cleaner may have a new shovel with a curved tip for better debris removal and cleaning/maintenance.

A spring may be custom hourglass.

Some pipe designs may mitigate heat. Pipe designs may include micro bumps, or lines, on a particular material.

In some embodiments a case system may be provided. The case system may comprise a case in accordance with exemplary embodiments and a funnel for loading herb into the cannabis compartment, or the like. The funnel may comprise a wider mouth portion and a narrower insert portion sized to fit snuggly within an opening of the cannabis compartment, or the like.

In embodiments of the present disclosure, a case may comprise engravable portions. For example, a user may wish to engrave a message, such as "Happy Birthday," on a portion of the case. The case may be engravable on all sides.

The above description is of a small number of embodiments for implementing the invention and is not intended to be limiting in scope. One of skill in this art will immediately envisage the methods and variations used to implement this invention in other areas than those described in detail.

In the disclosure and the claims, terms such as "first", "second", "third", "fourth", and the like, if any, will be used to distinguish similar components from each other and be used to describe a specific sequence or a generation sequence, but is not necessarily limited thereto. It will be understood that these terms are compatible with each other under an appropriate environment so that exemplary embodiments of the present invention set forth herein may be operated in a sequence different from a sequence illustrated or described herein. Likewise, in the case in which it is described herein that a method includes a series of steps, a sequence of these steps suggested herein is not necessarily a sequence in which these steps may be executed. That is, any described step may be omitted and/or any other step that is not described herein may be added to the method.

Here, a phrase "in an exemplary embodiment" means the same exemplary embodiment, but is not necessarily limited thereto. In addition, in the disclosure and the claims, terms such as "connected", "connecting", "linked", "linking", "coupled", "coupling", and the like, and various modifications of these terms may be used as the meaning including that one component is directly connected to another component or is indirectly connected to another component through the other component.

In addition, terms used in the present disclosure are for explaining exemplary embodiments rather than limiting the present invention. In the present disclosure, a singular form includes a plural form unless explicitly described to the contrary. Components, steps, operations, and/or elements mentioned by terms "comprise" and/or "comprising" used in the disclosure do not exclude the existence or addition of one or more other components, steps, operations, and/or elements.

Hereinabove, the present invention has been described with reference to exemplary embodiments thereof. All exemplary embodiments and conditional illustrations disclosed in the present disclosure have been described to intend to assist in the understanding of the principle and the concept of the present invention by those skilled in the art to which the present invention pertains. Therefore, it will be understood by those skilled in the art to which the present invention pertains that the present invention may be implemented in modified forms without departing from the spirit and scope of the present invention.

Therefore, exemplary embodiments disclosed herein should be considered in an illustrative aspect rather than a restrictive aspect. The scope of the present invention should be defined by the claims rather than the above-mentioned description, and equivalents to the claims should be interpreted to fall within the present invention.

While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. A hand-held case comprising:

a central compartment defined by an outer wall, the central compartment sized to accept a smokable herb;

a top lid comprising a cover for covering the central compartment, the top lid movable from a closed position to an open position;

a bottom lid comprising a slidable cover for covering a bottom compartment;

a tool compartment for storing a tool, the tool compartment disposed on a lateral side of the central compartment; and a pipe compartment for storing a pipe, the pipe compartment disposed on an opposite lateral side of the central compartment from the tool compartment;

wherein the top lid attached to the wall with a hinge; and wherein when the top lid is in a closed position, the hinge sits flush against the outer wall.

2. The hand-held case of claim 1, the top lid further comprising a magnet for securing the lid to the outer wall when the top lid is in the closed position, wherein the magnet is disposed on the cover in a position adjacent to the side wall when the top lid is in the closed position.

3. The hand-held case of claim 1, the top lid further comprising a seal on an interior surface of the lid adjacent the central compartment when the top lid is in the closed position, the seal making the inside of the central compartment substantially airtight when the top lid is in a closed position.

4. The hand-held case of claim 1, further comprising a grip comprising grooves for allowing a user to move the top lid between the closed position and the open position.

5. The hand-held case of claim 1, wherein the outer wall comprises steel.

6. The hand-held case of claim 1, further comprising a tool, the tool adapted to scoop out the smokable herb from the central compartment, compact the smokable herb, and clean the central compartment.

7. The hand-held case of claim 1, further comprising a pipe with a tapered center for allowing a user to more easily grip the pipe, the pipe for smoking a smokable herb.

8. The hand-held case of claim 7, wherein the pipe comprises a pipe filter slot for storing a p filter, the filter adapted to filter the smokable herb.

9. The hand-held case of claim 7, wherein the pipe is spring loaded with a spring at the bottom of the pipe compartment, wherein the pipe partially exits the pipe compartment when the top lid is moved from the closed position to the open position, and the top lid compresses the pipe against the spring when the top lid is the closed position.

10. The hand-held case of claim 1, wherein the bottom compartment comprises at least one filter compartment for storing one or more filters for use with a pipe.

11. The hand-held-case of claim 10, further comprising one or more filters for use with a pipe, the one or more filters stored within the at least one filter compartment.

12. The hand-held case of claim 11, wherein the one or more filters comprise an opening for accepting the smokable herb and a rounded bottom portion for seating within the pipe.

13. The hand-held case of claim 11, further comprising a funnel for seating within an opening at the top of the central compartment and allowing smokable herb to be transferred into the central compartment.

14. A hand-held case comprising:

a central compartment defined by an outer wall, the central compartment sized to accept a smokable herb;

a top lid comprising a cover for covering the central compartment, the top lid movable from a closed position to an open position, the top lid attached to the wall with a hinge, the top lid further comprising a magnet for securing the lid to the outer wall when the top lid is in the closed position;

a bottom lid comprising a slidable cover for covering a bottom compartment;

a tool compartment for storing a tool, the tool compartment disposed on a lateral side of the central compartment;

a pipe compartment for storing a pipe, the pipe compartment disposed on an opposite lateral side of the central compartment from the tool compartment;

a tool, the tool adapted to scoop out the smokable herb from the central compartment, compact the smokable herb, and clean the central compartment;

a pipe with a tapered center for allowing a user to more easily grip the pipe, the pipe for smoking a smokable herb, the pipe comprising filter slot for storing a pipe filter, the filter adapted to filter the smokable herb.

15. A method for using a hand-held case, the method comprising:

providing a hand-held case comprising:

a central compartment defined by an outer wall, the central compartment sized to accept a smokable herb;

a top lid comprising a cover for covering the central compartment, the top lid movable from a closed position to an open position, the top lid attached to the wall with a hinge, the top lid further comprising a magnet for securing the lid to the outer wall when the top lid is in the closed position;

a bottom lid comprising a slidable cover for covering a bottom compartment;

a tool compartment for storing a tool, the tool compartment disposed on a lateral side of the central compartment;

a pipe compartment for storing a pipe, the pipe compartment disposed on an opposite lateral side of the central compartment from the tool compartment;

a tool, the tool adapted to scoop out the smokable herb from the central compartment, compact the smokable herb, and clean the central compartment;

a pipe with a tapered center for allowing a user to more easily grip the pipe, the pipe for smoking a smokable herb, the pipe comprising filter slot for storing a pipe filter, the filter adapted to filter the smokable herb; and removing the pipe from the hand-held case;

placing a filter in the pipe; and removing the smokable herb and placing it in the filter.

* * * * *